US005669227A

United States Patent [19]

Morris

[11] Patent Number: 5,669,227

[45] Date of Patent: Sep. 23, 1997

[54] PORTABLE SKATING RINK

[75] Inventor: G. Gilbert Morris, Ajax, Canada

[73] Assignee: Original Shinny Rink Incorporated, Ajax, Canada

[21] Appl. No.: 586,216

[22] Filed: Jan. 16, 1996

[51] Int. Cl.[6] ..... F25C 3/02; A63C 19/10

[52] U.S. Cl. ..... 62/235

[58] Field of Search ..... 62/235; 4/506

[56] References Cited

U.S. PATENT DOCUMENTS

| | | | |
|---|---|---|---|
| 2,443,440 | 6/1948 | Alvarez | 4/506 |
| 2,996,896 | 8/1961 | Johnson | 62/235 |
| 3,460,705 | 8/1969 | Green | 4/506 |
| 3,808,831 | 5/1974 | Landry . | |
| 3,933,002 | 1/1976 | Vickery | 62/235 |
| 4,335,473 | 6/1982 | De Pous | 4/506 |
| 4,815,301 | 3/1989 | Deloughery . | |
| 5,134,857 | 8/1992 | Burley . | |

FOREIGN PATENT DOCUMENTS

| | | |
|---|---|---|
| 1127677 | 7/1982 | Canada . |
| 1210416 | 8/1986 | Canada . |

*Primary Examiner*—William E. Tapolcai

*Attorney, Agent, or Firm*—Paul J. Field

[57] ABSTRACT

The invention provides a portable ice skating rink including elongate curb structural members and a liner of flat flexible sheet material. The liner is economically made of sheet plastic for example with a bottom sheet and elongate sleeves around the periphery of the bottom sheet. The curb members, such as 4×4 lumber pieces, are inserted into an open end of each sleeve to form a water retaining structure. The sheet material and seams have resistance to water permiation sufficient to retain a shallow pool of water covering the bottom sheet during freezing in outdoor conditions to form an ice skating surface. Assembly of the rink is minimal. The user need only lay the liner in the intended location and slide the curb members into the preformed sleeves about the periphery. The interior depression formed is filled with water and allowed to freeze in outdoor conditions.

14 Claims, 5 Drawing Sheets

PORTABLE SKATING RINK

TECHNICAL FIELD

The invention is directed to an improved portable ice skating rink including elongate curb structural members and a liner of flat flexible sheet material.

BACKGROUND OF THE ART

Economically built ice skating rinks are known in the prior art for use in cold climates to provide recreational skating and hockey playing ice surfaces in backyards and parks.

The use of a simple built snow curb with a flooded central rink requires no material only labour. However when temperatures rise above freezing the rink surface and snow bank curb melts and must often be completely rebuilt.

Conventional responses to this problem have been partially successful. The most common backyard rink utilizes a wooden frame on a lawn surface. A plastic sheet is draped over the wooden frame and is flooded to form a shallow pool which freezes into an ice surface. The plastic liner contains melted ice water which would otherwise flow away or percolate into the underlying lawn surface.

The pressure of water on the wooden frame and the expansion of ice exert lateral forces on such crude frames resulting in water loss and distortion of the rink curb. As a result anchoring the frame to the lawn has been attempted however the problem remains while introducing damage to the underlying lawn.

U.S. Pat. No. 5,134,857 to Burley replaces the wooden peripheral frame with a rigid pipe assembly connected with elbow and straight couplings, and securing the plastic sheet with flexible C-shaped clips.

Several more elaborate variations on this basic structure have been introduced in the prior art generally requiring manual assembly of purchased materials. Such solutions have limited application since the primary advantage of the backyard ice rink is minimal cost and maintenance.

Examples of such assembled rinks are described in U.S. Pat. No. 4,815,301 to Deloughrey, U.S. Pat. No. 2,996,896 to Johnson, Canadian Patent 1,127,677 to Lyons, and Canadian Patent 1,210,416 to Bertoni. All of these examples require the purchase of specially designed curb assembly parts, extensive manual assembly and often require anchoring of the curb to the lawn surface with spikes.

The relatively high expense and complex assembly limits their applicability. As well the requirement to drive spikes into the underlying lawn surface introduces two difficulties. Firstly, undesirable lawn damage of some degree is inevitable. Secondly, such a rink may not be used on paved surfaces such as driveways, sidewalks, landscaped areas or adjacent swimming pool decks.

U.S. Pat. No. 3,808,831 to Landry abandons the assembled frame approach in favour of a one piece design which partially addresses the above difficulties with the prior art. Landry provides a plastic sheet with an integral watertight peripheral tube of sheet material. The periperal tube is filled with water and then sealed. The filled tube freezes to form a rigid curb for the flooded ice skating surface.

The disadvantage of using Landry's watertight plastic tube in close proximity to sharp ice skates is obvious. The frozen ice curb is rigid, however, the surrounding plastic peripheral tube is easily damaged by excited children during skating or hockey play. Cuts or punctures in the plastic tube allows melt water from the frozen curb to escape when cyclical thawing and freezing of winter weather occurs. The melting and escape of water deteriorates the ice curb structure beyond redemption. Repair of the plastic tube is possible of course, however, conditions are usually very wet, which complicates bonding of glues. As well the distortion of a partially melted and drained ice tube complicates refilling with water under pressure.

It is desirable therefore to produce a very inexpensive watertight liner with a rigid curb to contain the flooded ice surface which requires minimal assembly effort and material purchases.

It is also desirable to produce a liner which maintains its functionality when it is inevitably damaged by sharp ice skates or frozen hockey pucks. A desirable liner and curb assembly is easily and quickly repaired, in frozen conditions.

DISCLOSURE OF THE INVENTION

The invention provides a novel portable ice skating rink including elongate curb structural members and a liner of flat flexible sheet material. The liner is economically made of sheet plastic for example, with a bottom sheet and elongate sleeves around the periphery of the bottom sheet.

Rigid structural curb members, such as 4×4 lumber pieces, are inserted into an open end of each sleeve to form a water retaining curb structure. Assembly time is minimal including only laying out the liner and sliding in the 4×4 lumber curbs.

The sheet material and seams have resistance to water permiation sufficient to retain a shallow pool of water covering the bottom sheet during freezing in outdoor conditions to form an ice skating surface.

As a result, the rink structure does not require anchoring to the underlying surface. The rigid curb members are contained within perimeter sleeves such that lateral forces exerted by water pressure and expanding ice are resisted by the tensioning of the bottom sheet of the liner.

The curb maintains its integrity, and generally contains the melt water during thaws even if slashed by skates since the rigid curb members remain in place. Repairs in the sleeves need not be completely watertight and therefore the sleeves may be repaired using adhesive duct tape for example.

In accordance with the invention provides a portable ice rink liner and curb structure which overcomes the aforementioned disadvantages in a novel manner. Specifically, the invention provides a portable ice skating rink liner, of flat flexible sheet material joined with seams, comprising: a flat bottom sheet having a peripheral edge; a plurality of elongate peripheral curb sleeves each having an inward side extending from the bottom sheet edge to form an encircling curb, each sleeve having an open first end adapted to permit the sliding insertion of an associated curb structural member, and wherein the material and seams have resistance to water permiation sufficient to retain a pool of water covering the bottom sheet during freezing in outdoor conditions.

Also in accordance with the invention is provided a portable ice skating rink comprising: a plurality of elongate curb structural members; and a liner of flat flexible sheet material joined with seams, the liner comprising: a flat bottom sheet having a peripheral edge; a plurality of elongate peripheral curb sleeves each having an inward side extending from the bottom sheet edge to form an encircling curb, each sleeve having an open first end adapted to permit the sliding insertion of the associated curb structural member, and wherein the material and seams have resistance to water permiation sufficient to retain a pool of water covering the bottom sheet during freezing in outdoor conditions.

Further details of the invention and its advantages will be apparent from the detailed description and drawings included below.

BRIEF DESCRIPTION OF THE DRAWINGS

In order that the invention may be readily understood, two preferred embodiments of the invention and variations thereof will be described by way of example, with reference to the accompanying drawings wherein.

DETAILED DESCRIPTION OF PREFERRED EMBODIMENTS

Figure 1:
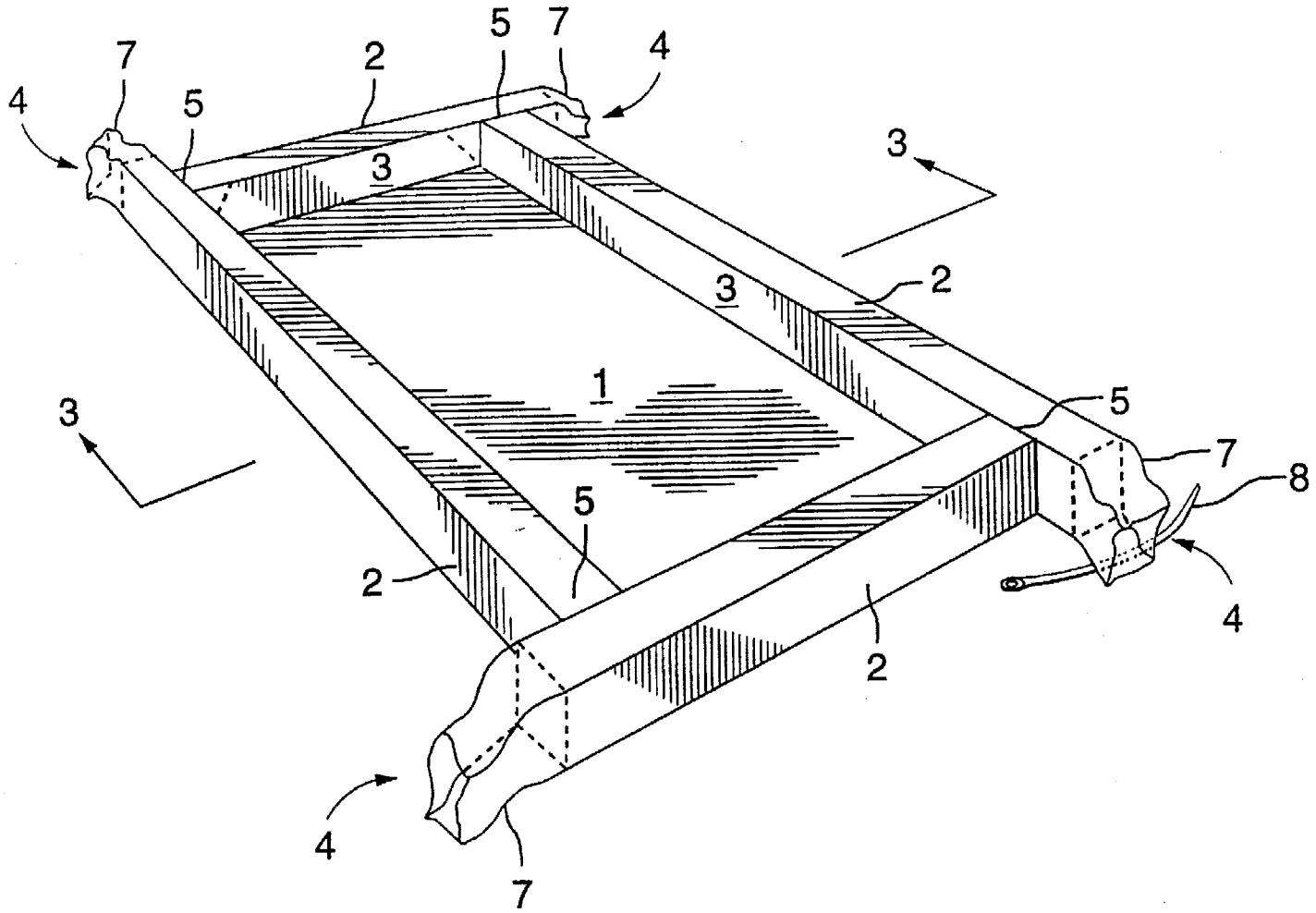
FIG. 1 is an upper perspective view of a portable ice skating rink showing the rigid structural members installed within the flexible sheet material sleeves surrounding a flat bottom sheet.

With reference to FIG. 1, the preferred embodiment of the portable ice skating rink includes a number of elongate curb structural members, for example as illustrated 4×4 lumber, and a liner of flat flexible sheet material joined together with seams.

The flexible liner includes a flat bottom sheet 1 having a peripheral edge about which is constructed a curb of 4×4 members each surrounded in a sleeve 2 of like flexible sheet material. Each elongate sleeve has an inward side 3 extending from the bottom sheet 1 to form the inner surface of a water retaining curb structure which encircles the bottom sheet 1.

Each sleeve 2 has an open end 4 which permits the rigid 4×4 structural members to be inserted by sliding into the interior of the sleeve 2. In the embodiment illustrated, each sleeve 2 also has a closed end 5 which adjoins the inward side 3 of an adjacent sleeve 2.

Figure 3:
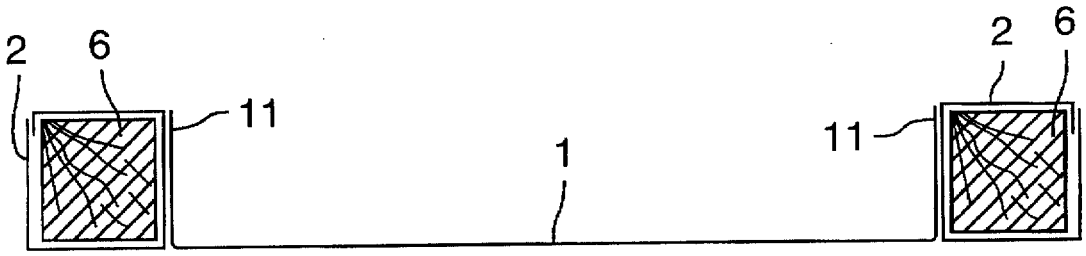
FIG. 3 is a sectional view along line 3—3 of FIG. 1, showing the first embodiment with separate bottom sheet and sleeves as in FIG. 2.

Referring to FIG. 3, it will be appreciated that the 4×4 structural members 6 are substantially enclosed within the sleeves 2. The sleeves 2 and bottom sheet 1 are of material and are joined together with seams such that the material and seams have resistance to water permiation sufficient to retain a pool of water coveting the bottom sheet 1. The material and seams need not be completely watertight since the head of water pressure in a shallow pool is low and the progression of freezing from outer to inner quickly reduces any leakage.

The T-shaped corner abutting of sleeves 2 and structural members 6 shown in FIG. 1 also aids in retaining water by strengthening the corner and impeding the path of water flow. Of course the rink may be made in any number of shapes, however the illustrated shape with a rectangular ice surface and curb sleeves 2 disposed at right angles is anticipated to be the most commonly used shape.

In order to reduce water damage to the structural members 6 and to better secure them within the sleeves 2, preferrably each sleeve 2 adjacent the open end 4 has a tail portion 7 extending outwardly beyond the associated adjacent sleeve 2. Releaseable ties may be used to close the open end 4.

The open end 4 and tail portion 7 also is useful in accomodating and enclosing any portion of the structural member 6 which extends beyond the curb. As a result structural members 6 need not be cut to any specified length. This reduces assembly effort and enables reuse of lumber in warmer months.

It will be apparent that structural members 6 may be made of cut lengths of any elongate material having a substantially uniform transverse cross-section. Although the example of lumber is used, other materials perform to equal advantage if economically available including: plastic pipes; polystyrene blocks; extruded aluminium or plastic sections; rolled steel sections; or bent sheet metal sections. It is expected however that lumber is the most economical material since scrap material can be nailed together into the desired size, and many homeowners have bits and pieces of lumber laying about for just such an eventuality. Lumber may also be used for other purposes in warmer months whereas specially made members of other materials require storage. Use of pressure treated lumber may reduce water damage to the wooden curb members, however due to frozen conditions, insect and rot damage is unlikely.

Figure 6:
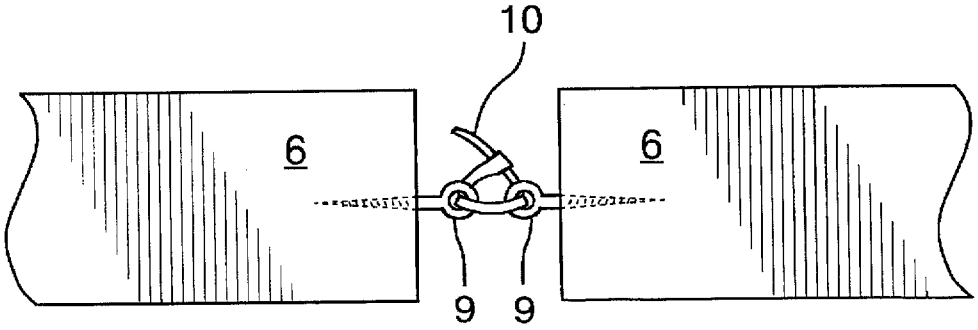
FIG. 6 is an elevation view of a joint between adjacent structural members when short lengths are used to form the required length to fill a sleeve.
Figure 7:
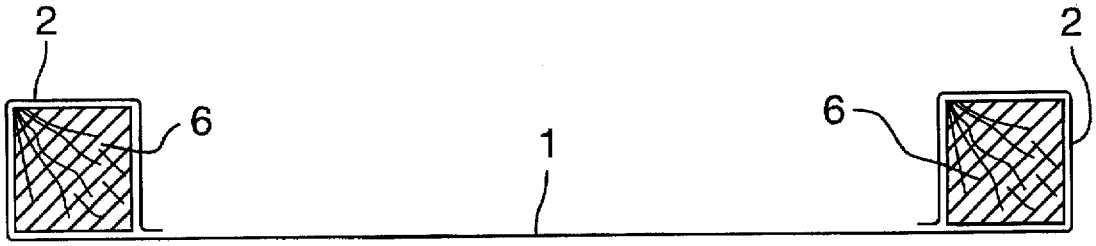
FIG. 7 is a sectional view along line 3—3 of FIG. 1, showing the second embodiment with integrally formed bottom sheet and sleeves as in FIGS. 8–12.

For ease of dismantling, it is desirable to join end to end short lengths of lumber to build the length required to fill a long curb sleeve 2. One means of joining lumber pieces together for easy withdrawal from the sleeves 2 is shown in FIG. 6. Where at least two structural members 6 are of a length less than the length of the associated sleeve 2, they may be releaseably joined with a flexible coupling. As shown a simple flexible coupling consists of screw eyelets 9 joined together with a flexible cable tie 10. Other suitable couplings include rope, split chain links, spring locking C-clips and other commonly available releasable connectors.

Quite often the backyard areas where such a rink is to be built is not completely level or are sloped. The use of rigid curb members 6 has the advantage that to level the curb, the user need only shim the curb by placing 2×4 or other wider lumber under the curb and sleeve 2. It is estimated that a slope of approximately up to 10 inches over the length of the rink can be easily accomodated in this manner.

To protect the sleeves 2 from damage, snow may be piled up around the rink periphery on top of the sleeves 2. This has the added advantage that over time the rink level will be built up with repeated floodings such that the entire liner and curb structure are submerged in a protective layer of ice. However, when substantial melting occurs, the liner remains able to contain much of the melt water, snow and rain to prevent severe flooding of adjacent areas, neighbour's yards etc. and to automatically form a new frozen ice skating surface when temperatures drop below freezing again.

Figure 2:
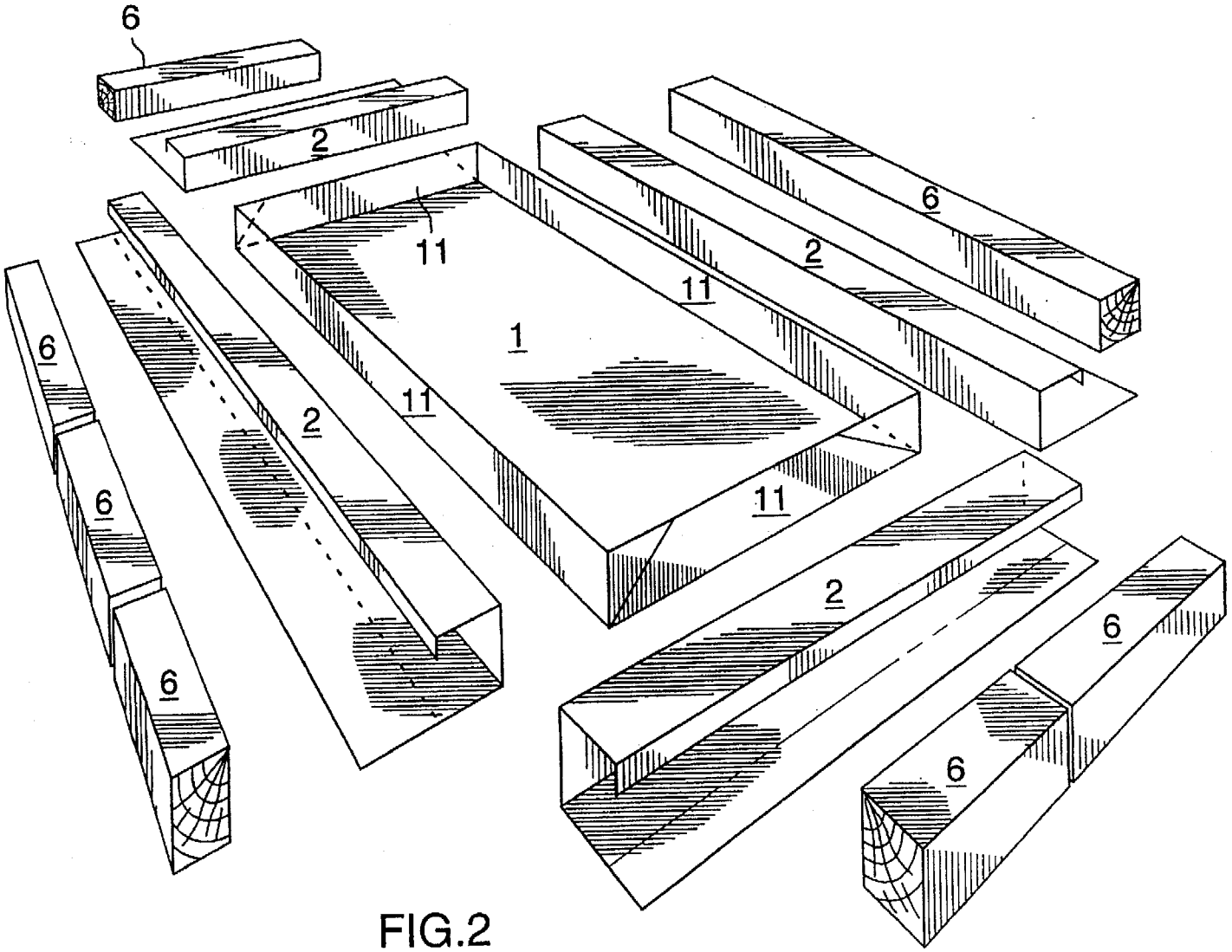
FIG. 2 is a like exploded view of a first preferred embodiment, from inward to outward, showing: the central bottom sheet with a folded upward peripheral lip; sleeves around the periphery opened along a longitudinal seam to illustrate the method of forming sleeves from sheet material; and elongate rigid structural members, as illustrated in the form of 4×4 lumber pieces.

Turning to the construction of the liner, reference is made to FIG. 2. The flexible sheet material of which the bottom sheet 1 and sleeves 2 are formed is most economically chosen as a plastic sheet material with heat sealed seams. However it is likely that for increased wear resistance or manufacturing simplicity other materials such as woven material of plastic or synthetic strands, or natural strands may be used. Seams may also be glued or sewn to equal advantage.

As well if desired the sleeves 2 may be formed of sheet material having abrasion and cut resistant properties substantially greater than those of the bottom sheet 1, since exposure to skates, hockey sticks and pucks is much greater. In general though placing piles of snow over the sleeves 2 will give a degree of protection at no cost. Sheets of plywood or scrap lumber may also be placed over the sleeves 2 to protect areas of high traffic wear.

Figure 4:
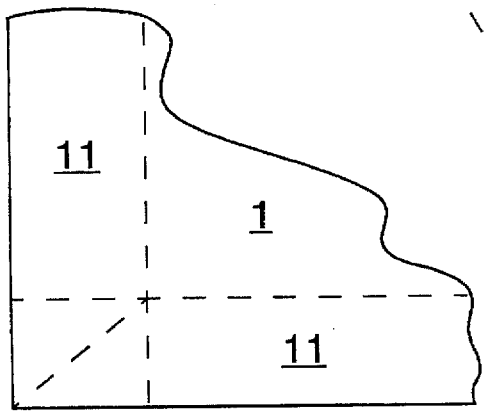
FIGS. 4 and 5 are plan and perspective views respectively of a corner of the bottom sheet showing the method of forming the lip illustrated in FIG. 2.
Figure 5:
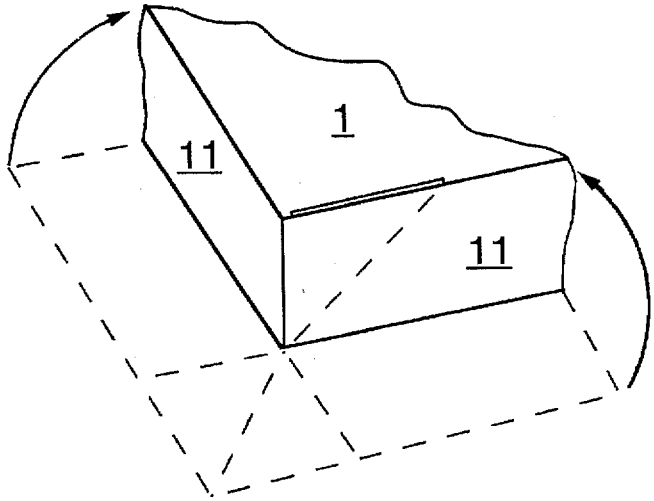

The first preferred embodiment shown in FIG. 2, includes a bottom sheet 1 having an upwardly folded peripheral lip 11. FIGS. 4 and 5 show the progressive steps in forming a folded over corner and the lip 11. The corner detail may be secured by heat sealing, sewing or glueing in a like manner.

The sleeves 2 as shown in FIG. 2 are also formed of flat sheet material by first folding the material into a tube and forming a longitudinal seam. The lip 11 and sleeves 2 are then joined together with seams to form the completed liner ready for insertion of the 4×4 members 6 in the sleeves 2.

Figure 8:
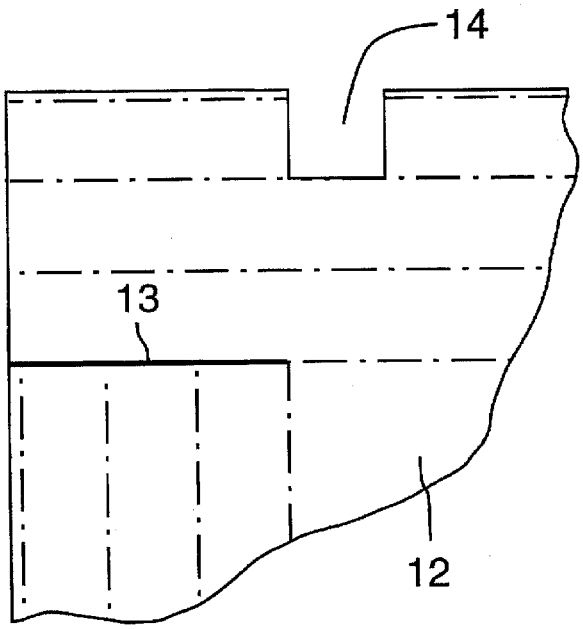
FIG. 8 is a plan view of one corner of a flat sheet blank which is slit at the left edge as drawn, and the blank periphery is folded upon itself along the dashed lines to form the sleeves.
Figure 9:
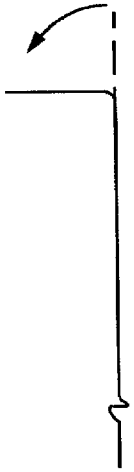
FIGS. 9, 10 and 11 show the progressive steps of folding the blank periphery to form the completed integral sleeve of FIG. 11.
Figure 10:
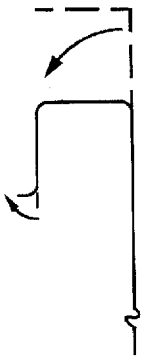
Figure 11:
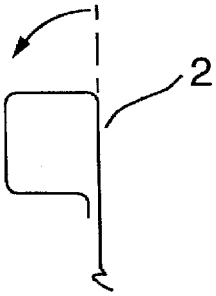
Figure 12:
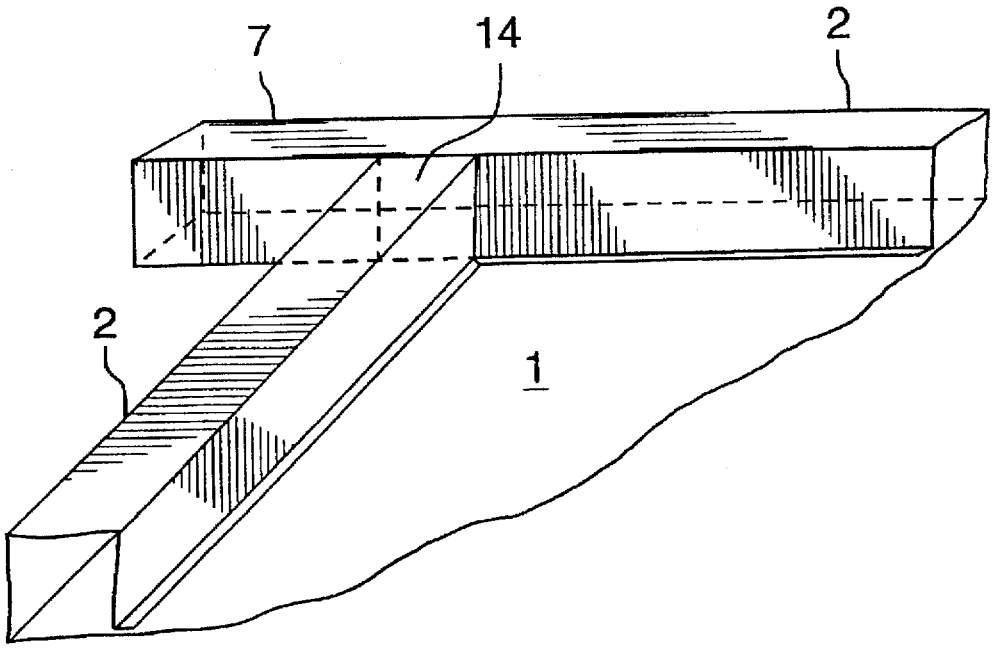
FIGS. 12 and 13 are perspective views of the completed second embodiment, showing the bottom sheet in the forground and tail portion extending beyond abutting sleeves.

A second preferred embodiment is shown in FIGS. 7–12 wherein the bottom sheet 1 and sleeves 2 are integrally formed from a flat sheet blank 12. The blank 12 is firstly slit at its edges in each corner along cut line 13 as shown in FIG. 8. The blank 12 is then folded progressively as shown in FIGS. 9–11 upon itself to form the sleeves 2. Using this method, the tail portion 7 is formed as well. In FIG. 8, a square cutout 14 is shown which optionally results in an opening between sleeves as shown in FIG. 12. This opening is useful in allowing air to escape from the interior of the sleeve 2 when structural members 6 are inserted into a snugly fitting sleeve 2. When the lumber is fully inserted, the tail portion 7 is closed with a tie 8.

It will be apparent that virtually any size or shape of rink may be constructed using the invention, however it is anticipated that the likely range for commercial products would be for rectangular rinks from 10×12 feet to 40×60 feet. Custom sizes and shapes can be manufactured as are tarpaulins conventionally.

Figure 13:
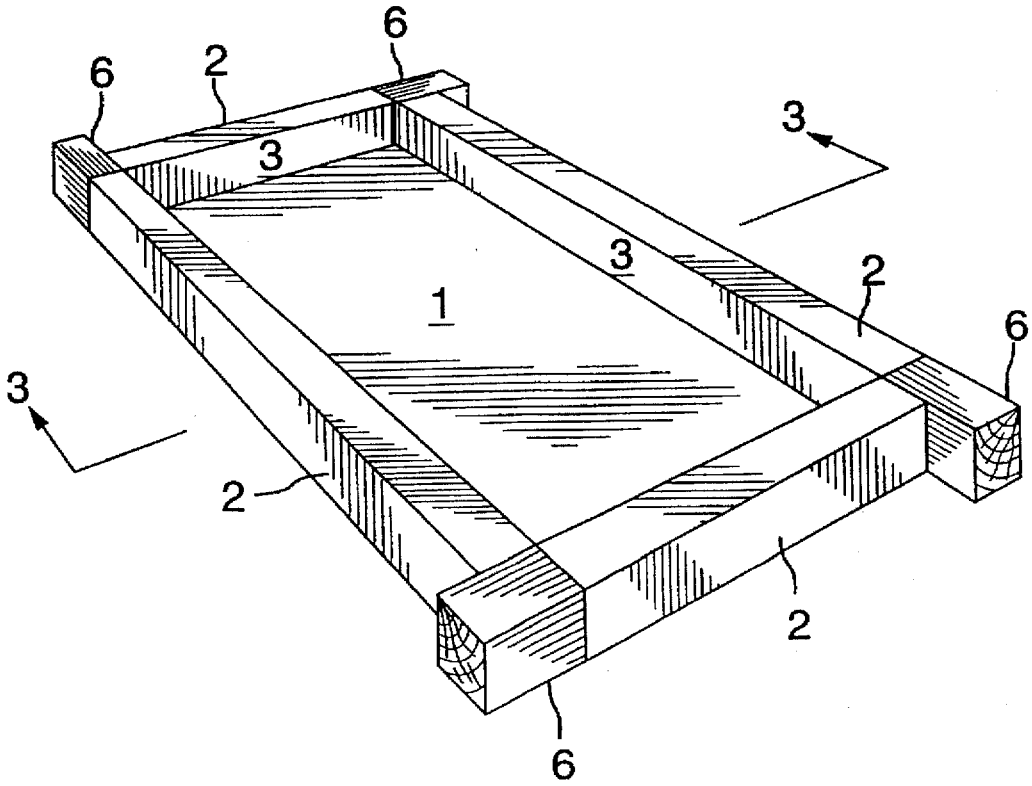

A modification which has proved practical in larger length rinks is to produce sleeves 2 with open ends 4 at both extreme ends of the sleeves 2. This enables long lengths of lumber to be slid into the sleeves 2 from both ends reducing the labour involved. With reference to FIG. 13, such a liner may be produced by making the sleeves 2 of a length equal to the length of the adjacent edge of the bottom sheet 1. Since both ends of the sleeves 2 are open, the structural members 6 can be inserted from both ends. It is not critical that the sleeves 2 entirely cover the structural members 6.

It is anticipated that a commercial embodiment of the invention will include decals or stencils to enable users to ably markings to the finished ice surface, such as hockey team logos, hockey game lines and face-off marks etc. Although it is possible to print such marks on the bottom sheet 1 itself, it has been found that unacceptable visual clouding and distortions may occur when very thick ice is produced over the bottom sheet.

Although the above description and accompanying drawings relate to specific preferred embodiments as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A rectangular portable ice skating rink liner, of flat flexible sheet material joined with seams, comprising:

a rectangular flat bottom sheet having a four sided peripheral edge;

four elongate peripheral curb sleeves each having a vertical inward side extending from an associated side of the bottom sheet edge to form an upstanding rectangular curb with four vertical corner seams defined by intersection of the vertical inward sides of adjacent sleeves, each sleeve having an open first transverse end adapted to permit the longitudinal sliding insertion and removal of an associated elongate rectilinear rigid curb structural member, and a second transverse end adapted to permit abutting right angle corner engagement of a forward planar end of the associated rigid curb member with an inside planar side of an adjacent rigid curb member; and wherein the material and seams have resistance to water penetration sufficient to retain a pool of water covering the bottom sheet during freezing in outdoor conditions.

2. A liner according to claim 1, wherein each sleeve adjacent the open first end has a tail portion extending outwardly beyond the associated adjacent sleeve.

3. A liner according to claim 2, wherein each tail portion includes releaseable tie means for closing the open end.

4. A liner according to claim 1, wherein the bottom sheet includes a peripheral lip, the sleeves comprises tubes of sheet material, and the lip and each sleeve tube is joined by a seam.

5. A liner according to claim 1, wherein the bottom sheet and sleeves are integrally formed from a flat sheet blank with slit edges, and the blank periphery is folded upon itself to form the sleeves.

6. A liner according to claim 1, wherein the flexible sheet material is selected from the group comprising: plastic sheet material; woven material of plastic or synthetic strands; and woven material of natural fibre strands.

7. A liner according to claim 1, wherein the seams in the flexible sheet material are selected from the group comprising: heat sealed seams; glued seams; and sewn seams.

8. A rectangular portable ice skating rink comprising:

a plurality of elongate rectilinear rigid curb structural members; and a rectangular liner of flat flexible sheet material joined with seams, the liner comprising:

a rectangular flat bottom sheet having a four sided peripheral edge;

four elongate peripheral curb sleeves each having a vertical inward side extending from an associated side of the bottom sheet edge to form an upstanding rectangular curb with four vertical corner seams defined by intersection of the vertical inward sides of adjacent sleeves, each sleeve having an open first transverse end adapted to permit the longitudinal sliding insertion and removal of an associated elongate rectilinear rigid curb structural member, and a second transverse end adapted to permit abutting right angle corner engagement of a forward planar end of the associated rigid curb member with an inside planar side of an adjacent rigid curb member; and wherein the material and seams have resistance to water penetration sufficient to retain a pool of water covering the bottom sheet during freezing in outdoor conditions.

9. A portable ice skating rink according to claim wherein each sleeve has a second end adjoining the inward side of an adjacent sleeve.

10. A portable ice skating rink according to claim 8, wherein the structural members are cut lengths of elongate members having a substantially uniform transverse cross-sectional profile selected from the group consisting of: lumber; pipe sections; polystyrene blocks; extruded aluminium sections; extruded plastic sections; rolled steel sections; and bent sheet metal sections.

11. A portable ice skating rink according to claim 10, wherein at least two of the structural members are of a length less than the length of an associated sleeve.

12. A portable ice skating rink according to claim 11, wherein the structural members within an associated sleeve are releaseably joined together with flexible coupling means.

13. A portable ice skating rink according to claim 12, wherein the structural members are lumber and the flexible coupling means comprise screw eyelets joined with a flexible cable tie.

14. A portable ice skating rink according to claim 8, wherein the sleeves are of a sheet material having abrasion and cut resistant properties substantially greater than those of the bottom sheet.

* * * * *